US006808400B2

(12) United States Patent
Tu

(10) Patent No.: US 6,808,400 B2
(45) Date of Patent: Oct. 26, 2004

(54) USB CONNECTOR STRUCTURE WITH PROTECTION MEANS

(75) Inventor: Hsin-Hung Tu, Hsinchu (TW)

(73) Assignee: AIPTEK International Inc., Hsinchu (TW)

( * ) Notice: Subject to any disclaimer, the term of this patent is extended or adjusted under 35 U.S.C. 154(b) by 0 days.

(21) Appl. No.: 10/272,937

(22) Filed: Oct. 18, 2002

(65) Prior Publication Data

US 2004/0077216 A1 Apr. 22, 2004

(51) Int. Cl.[7] ..... H01R 13/44; H01R 13/60
(52) U.S. Cl. ..... 439/131
(58) Field of Search ..... 439/131, 136, 439/140, 141

(56) References Cited

U.S. PATENT DOCUMENTS 6,456,500 B1 * 9/2002 Chen ..... 361/752

* cited by examiner

*Primary Examiner*—Javaid H. Nasri
(74) *Attorney, Agent, or Firm*—Troxell Law Office PLLC

(57) ABSTRACT

The present invention relates to a USB structure with a protection device, especially applying to a USB connector structure without traditional cap but still with protection function. The present invention adopts simple mechanism, spring and positioning structure, pivotal structure and rotational structure, to approach protection object, therefore it saves a lot on cost and manufacturing processes.

3 Claims, 6 Drawing Sheets

USB CONNECTOR STRUCTURE WITH PROTECTION MEANS

FIELD OF THE INVENTION

The present invention relates to a USB connector structure with protection means, especially applying to a USB connector structure without traditional cap but still with protection function.

BACKGROUND OF PRIOR ART

For the past several years, USB has being applied to the field of data communication. It is just because of its functions of fast communication speed, plug and play (PnP) and no need to restart computer, and the peripheral is then brought to a new application century, such as CD-ROM, CD Recorder, mobile hard disk, digital recorder, digital camera, digital camcorder, etc. Thus, as we can see, the USB application is already around anywhere to us.

The storing interfaces of hard disk in a PC or a mobile computer, MO, floppy disk (1.4 MB), CD (600 MB) CD-RW, etc. are different, and those are disadvantageous for carrying, storing and cost. Gradually, a new product is then generated, called thumb drive, which is specially for being carried data. The thumb drive has the features of enough capacity, fast communication, easy carrying, low cost, etc., and they totally break through the bottleneck for earlier computer peripheral storing data.

Please refer to FIG. 1, which is a schematic diagram of a USB plug in prior art. Normally there is a cap 11 to protect a USB connector 13. After the cap 11 covering on the USB connector 13, a figure of the cap 11 is just matched with a figure of a case 15, and it seems like they become one body. The body can protect both the USB connector 13 and electrical parts (not shown in figure). During usage, cap 11 may be taken off from the case 15 and easily lost. Once cap 11 is lost, USB connector 13 may then be simply damaged. Hence, how to improve the disadvantage in prior art is the major discussion of the present invention.

SUMMARY OF THE INVENTION

The major object of the present invention is to provide a USB connector structure with protection means to protect the USB connector, further to avoid loosing protection means in prior art.

The secondary object of the present invention is to provide a USB connector structure with protection means to extend the lifetime of the USB connector, further to decrease user's cost.

To further understand and recognize the object, function and characteristic of the present invention, the esteemed review committee members please refer to the detailed description and corresponding diagrams of the present invention as following:

DETAILED DESCRIPTION OF THE PREFERRED EMBODIMENTS

Figure 1:
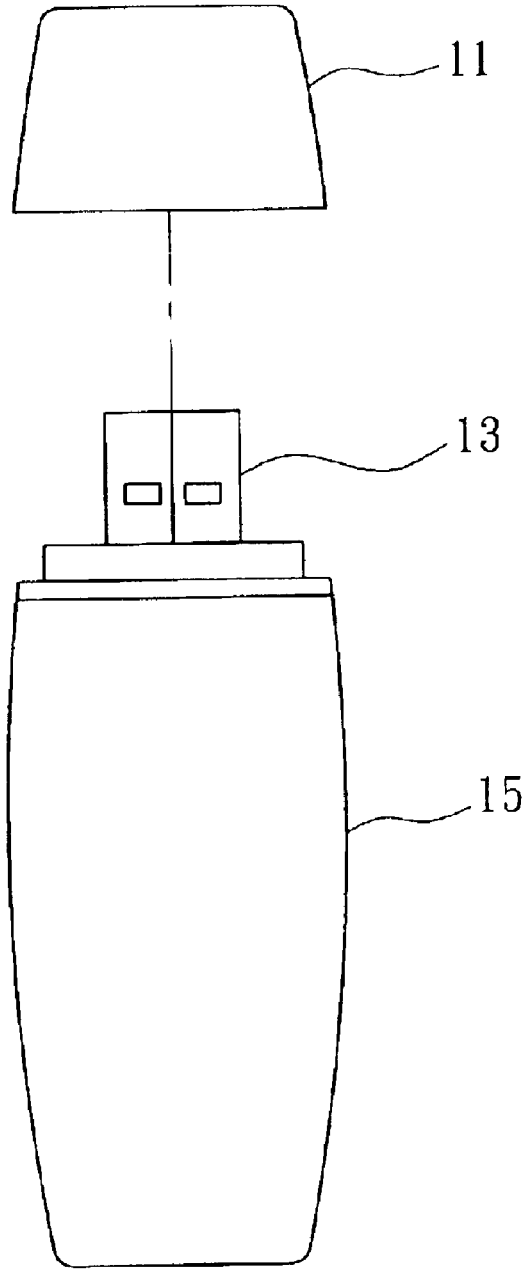
FIG. 1 (PRIOR ART)
FIG. 1 is a schematic diagram of a USB plug in prior art.
Figure 2B:
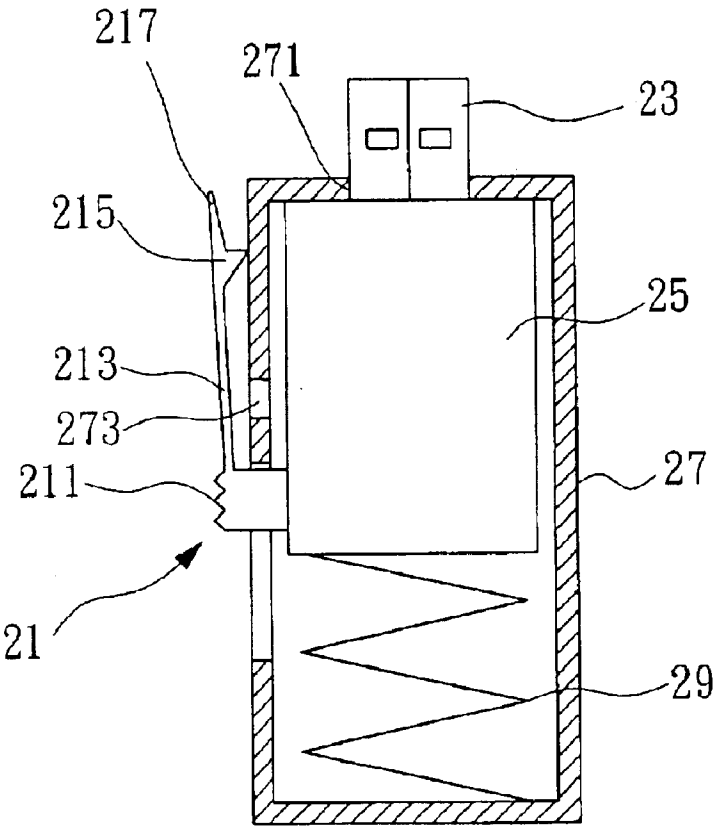
FIGS. 2A and 2B are the first embodiment of the present invention.
Figure 2A:
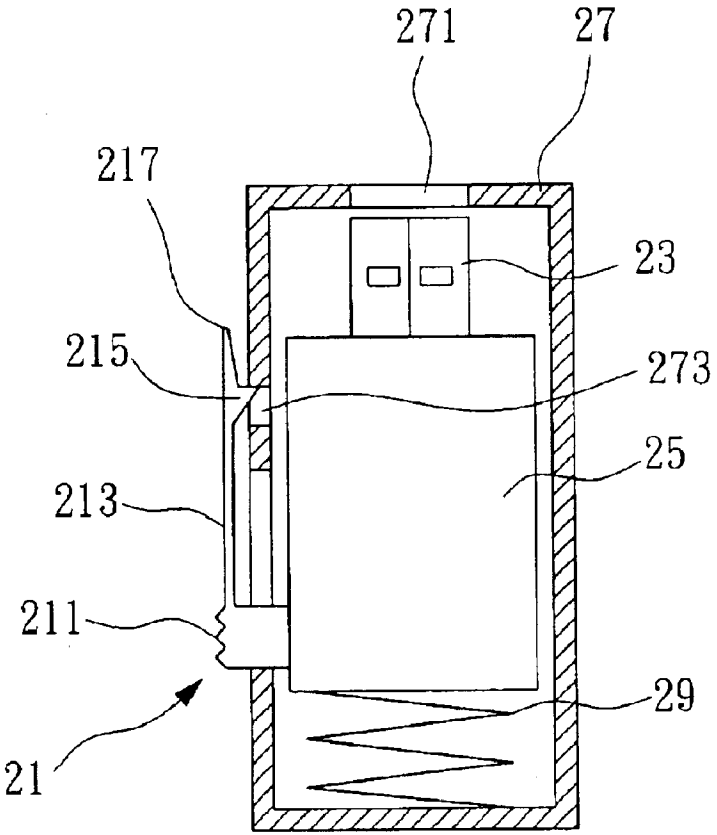

The present invention has being provided for business application and protection from patent law. Referring to FIG. 2, which is the first embodiment of the present invention. FIG. 2A shows a USB connector 23 being fit into a case 27; the USB connector 23 connects to a PCB 25, and a bottom of the PCB 25 has a spring 29 for withstanding between the bottom of the PCB 25 and an internal surface of a bottom of the case 27. Meanwhile the spring 29 is depressed by a positioning structure 21. A buckling piece 215 inserts into a buckling hole 273, other components as a poking piece 217, an extended arm 213 and a pushing button 211 is actually with the buckling piece 215 in one body so as to keep the PCB 25 staying with the present status. When the poking piece 217 is poked up, the buckling piece 215 is then taken off from the buckling hole 273, shown as figure 2B; continuously USB connector 23 is protruded out from a USB exit 271.

Figure 3B:
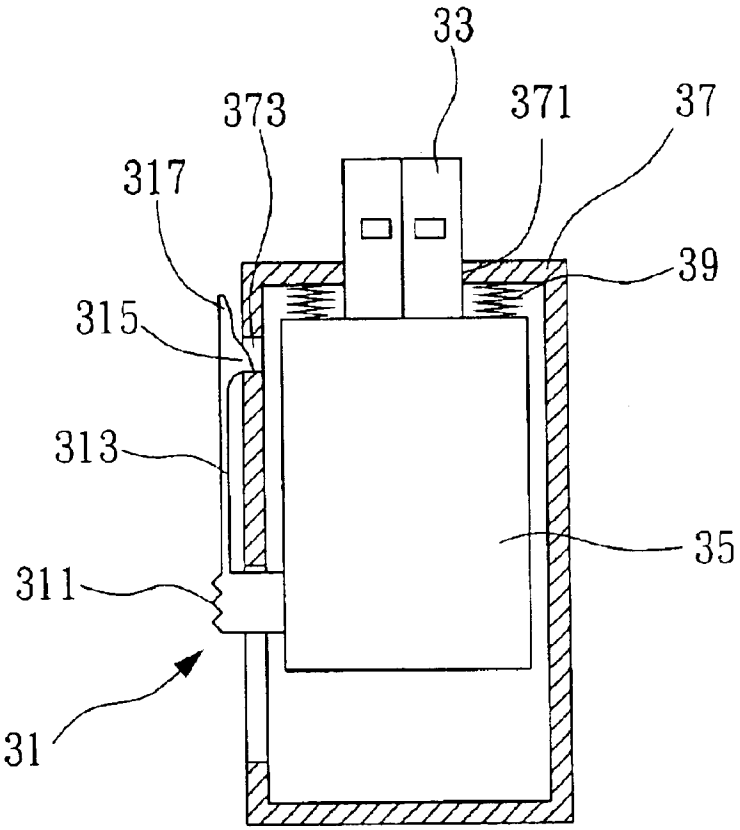
FIGS. 3A and 3B are the second embodiment of the present invention.
Figure 3A:
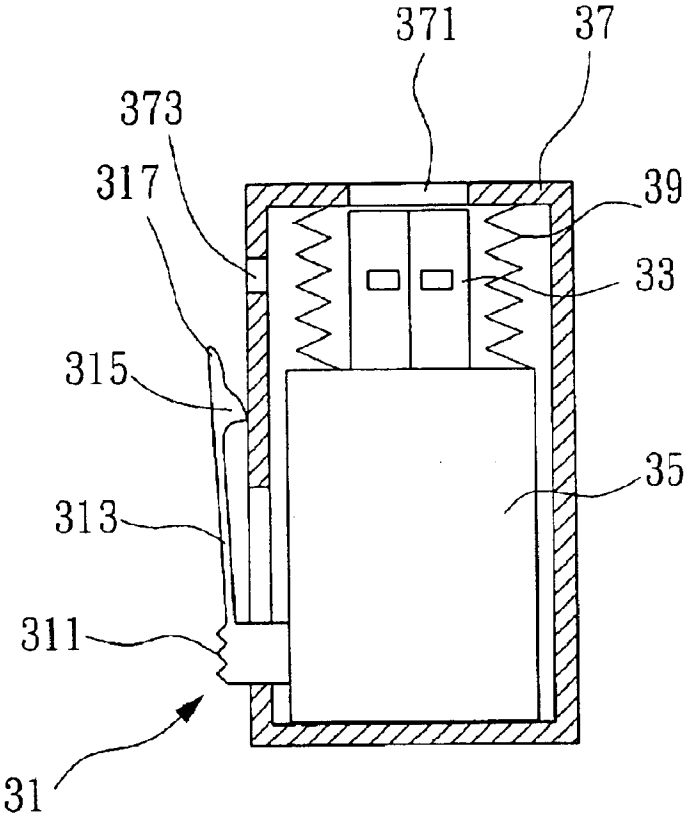

Referring to FIG. 3, which is the second embodiment of the present invention. FIG. 3A shows a USB connector 33 being hidden in a case 37; the USB connector 33 connects to a PCB 35, and a top of the PCB 35 has a plurality of springs 39 for withstanding between an internal surface of a top of the case 37 and the top of PCB 35. Meanwhile the springs 39 are elongated. Depressing and pushing a pushing button 311 of a positioning structure 31 upward makes that a buckling piece 315 being inserted into a buckling hole 373 because of the pushing button 311, an extended arm 313 and the buckling piece 315 are in one body; on the other hand, pushing button 311 connects with PCB 35 so as to that USB connector 33 is protruded out from a USB exit 371, shown as FIG. 3B. At the moment, the springs 39 are depressed, and slightly poking up a poking piece 317 to take buckling piece 315 off the buckling hole 373 for recovering back to the status shown as FIG. 3A via spring force.

Figure 4B:
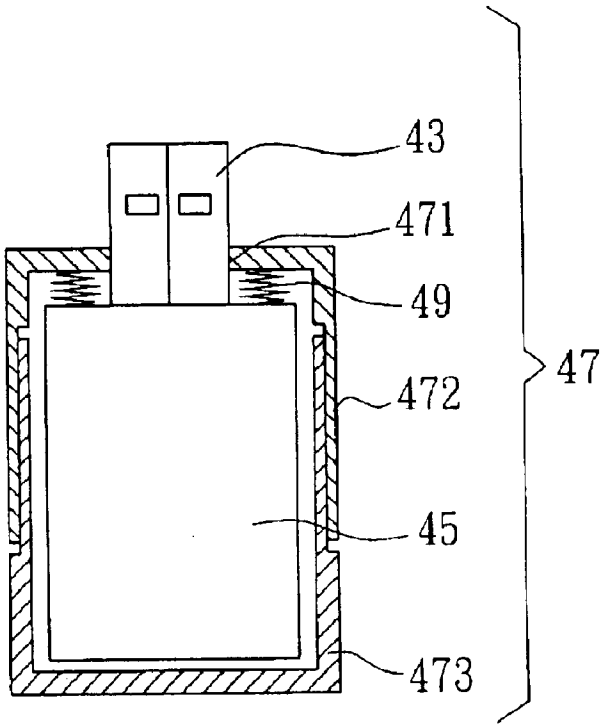
FIGS. 4A and 4B are the third embodiment of the present invention.
Figure 4A:
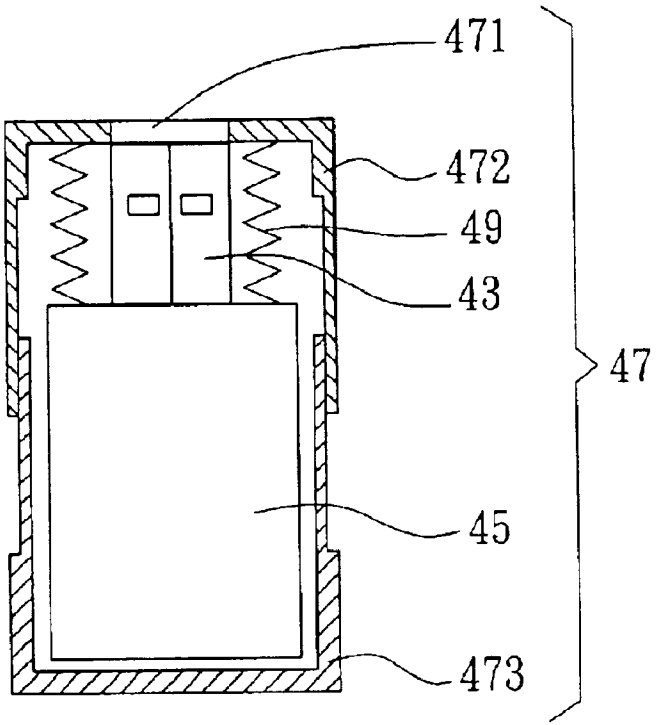

Referring to FIG. 4, which is the third embodiment of the present invention. As shown in FIG. 4A, a case 47 comprises a fixing case 473 and a moving case 472. An upper part of the fixing case 473 are wrapped in the moving case 472, and moving case 472 is capable of sliding up and down on fixing case 473. In the meantime, plural springs 49 withstand between a PCB 45 and a top of moving case 472 and are in elongation. To press moving case 472 downward is to let that a USB connector 43 goes out of moving case 472 via a USB exit 471, as shown in FIG. 4B.

Figure 5B:
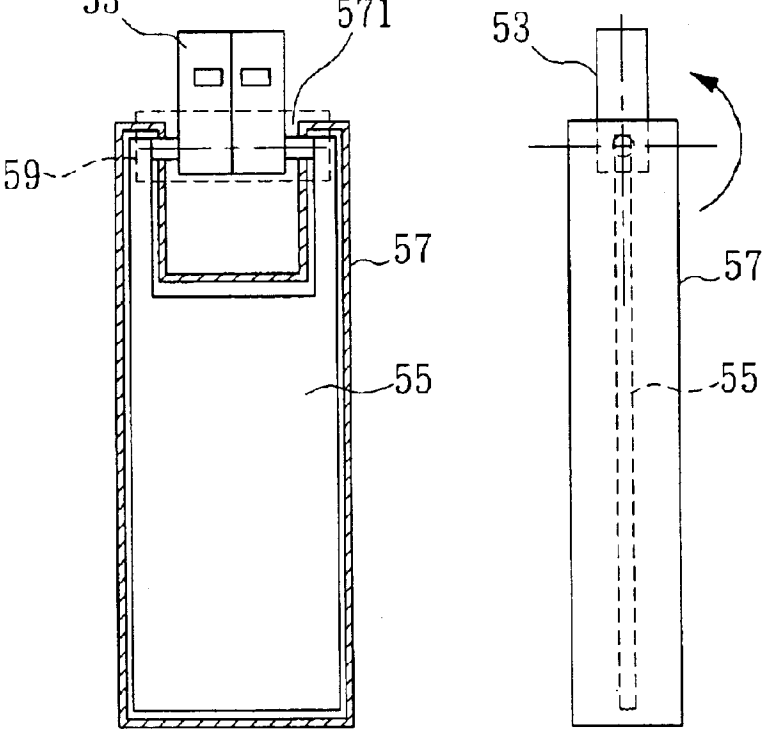
FIGS. 5A and 5B are the fourth embodiment of the present invention.
Figure 5A:
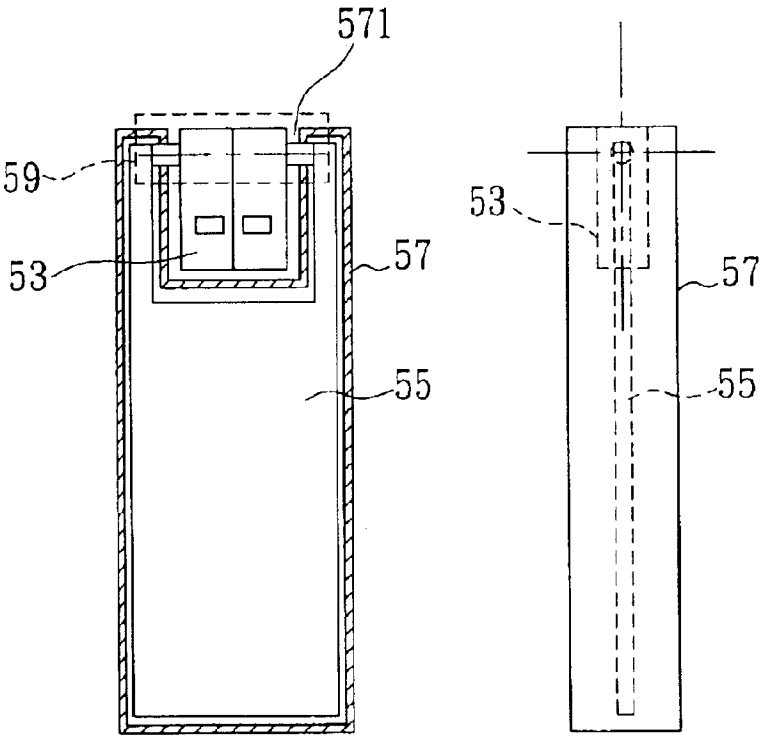

Referring to FIG. 5, which is the fourth embodiment of the present invention. As shown in FIG. 5A, a USB connector 53 is hidden in an empty place of a case 57. The USB connector 53 pivots on a PCB 55 via a pivotal structure 59 for both structure connection and electrical connection, such as pivotal means of keyboard and LCD of general portable computer, and there are several wires in the pivotal means. The pivotal structure 59 is able to have pivotal connection with USB connector 53 for turning USB connector 53 over so as to that USB connector 53 being protruded out from a USB exit 571, as shown in FIG. 5B.

Figure 6B:
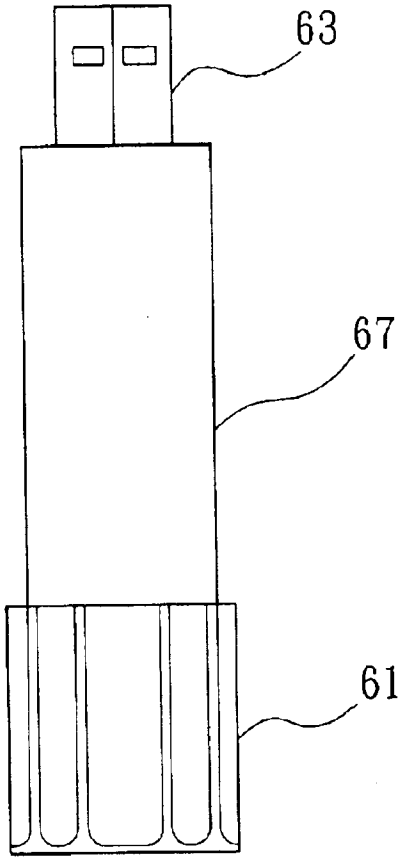
FIGS. 6A and 6B are the fifth embodiment of the present invention.
Figure 6A:
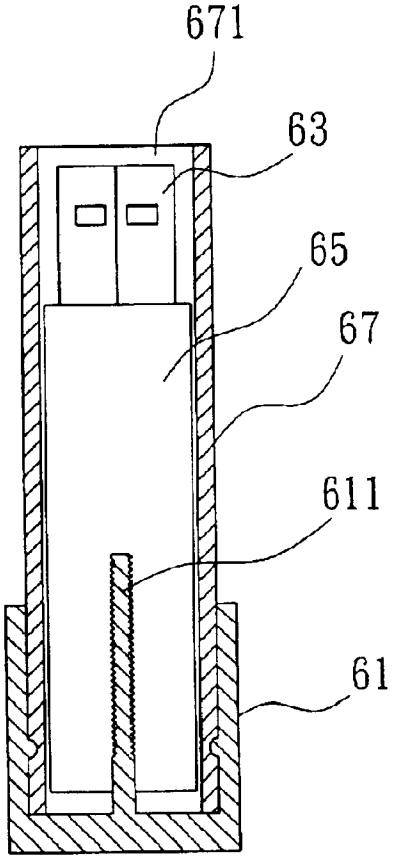

Referring to FIG. 6, which is the fifth embodiment of the present invention. The embodiment adopts a screw mechanism to protrude a USB connector out of a case. As shown in FIG. 6A, a USB connector 63 connects with a PCB 65, which lodges with a guiding rod 611; namely the PCB 65 has a toothlike structure, which is just matched with the guiding rod 611. A rotational base 61 wraps over a bottom of a case 67, and a protruding object on the rotational base 61 cooperates with a slot on the case 67 to make the rotational base 61 circulate on the case 67. Guiding rod 611 and rotational base 61 are in the same body, the rotational base 61 is able to move the PCB 65 and the USB connector 63 up and down via guiding rod 611; continuously the USB connector 63 goes out of case 67 through a USB exit 671.

To conclude the above embodiments, the present invention adopts simple design to approach the protection purpose, such as spring and positioning structure, pivotal structure and rotational structure. As it can be seen, the present invention is capable of saving cost and manufacturing processes.

The above-descriptions are the preferable embodiments of the present invention, however, the covered scope of the present invention is not limited to the embodiments shown in this invention. Any changes according to the content of the present invention and the resulted functions and characteristics are similar to the embodiments of the present invention and the ideas created by all such technology well-known persons are all belonged to the covering scopes of the present invention.

What is claimed is:

1. A protection device for a USB connector structure connected with an electrical device, said protection device comprising:

at least one case having a USB exit, the USB connector structure retractably located in one end of said case, both the USB connector structure and the electrical device are axially movable in the case, the USB connector structure retractably protruding out of the USB exit of the case;

at least one positioning structure connected with the electrical device and being located on an exterior of the case and moving the USB connector structure from one end of the case to another; and at least one elastic component located in the case and moving the USB connector structure.

2. The protection device according to claim 1, wherein the at least one elastic component is located between the electrical device and an end of the at least one case opposite the USB exit.

3. The protection device according to claim 2, wherein, when the at least one elastic component is in a compressed state, the positioning structure selectively maintains and releases the compressed state of the elastic component, such that when the elastic component is released the USB connector structure protrudes out of the case through the USB exit.

* * * * *